US007322859B2

(12) United States Patent
Evans

(10) Patent No.: US 7,322,859 B2
(45) Date of Patent: Jan. 29, 2008

(54) ELECTRICAL CONNECTOR

(75) Inventor: Kevin Evans, Basing Stoke (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 11 days.

(21) Appl. No.: 11/507,195

(22) Filed: Aug. 21, 2006

(65) Prior Publication Data

US 2007/0037430 A1 Feb. 15, 2007

Related U.S. Application Data

(63) Continuation-in-part of application No. PCT/GB2005/000291, filed on Jan. 27, 2005.

(30) Foreign Application Priority Data

Feb. 26, 2004 (GB) ..... 0404280.0

(51) Int. Cl.
*H00R 13/625* (2006.01)

(52) U.S. Cl. ..... 439/671; 439/140

(58) Field of Classification Search ..... 439/140, 439/332, 335, 346, 671, 889
See application file for complete search history.

(56) References Cited

U.S. PATENT DOCUMENTS 3,500,291 A 3/1970 Hubbell et al.
4,074,341 A 2/1978 Niederost et al.
5,685,730 A 11/1997 Cameron et al.
5,921,823 A * 7/1999 Bernardini ..... 439/889
6,309,231 B1 * 10/2001 Gordon et al. ..... 439/140

FOREIGN PATENT DOCUMENTS

EP 0 447 144 A1 9/1991
EP 0 895 313 A2 2/1999
EP 1 081 799 A2 3/2001

* cited by examiner

*Primary Examiner*—James Harvey
(74) *Attorney, Agent, or Firm*—Peter Van Winkle

(57) ABSTRACT

A bayonet electrical connector has a spring loaded safety pin for locking the bayonet coupling. The pin projects into a recess, and a sleeve surrounds the part having the recess. The sleeve has a tab which projects into the recess, the sleeve being slidable to make the tab depress the pin against the spring bias of the pin, thereby to enable subsequent disconnection of the bayonet coupling. This design maintains a locking mechanism to prevent accidental decoupling of the bayonet connection, but makes the decoupling process simpler, by using, sliding of the sleeve and twisting to release the bayonet coupling.

13 Claims, 3 Drawing Sheets

ELECTRICAL CONNECTOR

CROSS-REFERENCE

This is a Continuation-In-Part of PCT/GB2005/000291 filed 27 Jan. 2005 which designated the US and which claimed priority from British patent application GB 0404280.0 filed 26 Feb. 2004.

BACKGROUND OF THE INVENTION

This invention relates to electrical connectors, and more particularly to high power safety connectors.

The terminals of high current electrical connectors are typically much larger than for domestic electrical connectors, and it can be possible for a person to insert a finger or other object into a socket opening and touch electrically live components within the socket.

There are various designs of electrical connector which provide a safety feature, to reduce the risk of live contacts being accessible when the connector is disconnected.

U.S. Pat. No. 6,309,231 discloses an electrical connector in which the mating surfaces of the male and female connectors present only insulating components to the user. Furthermore, to separate the male and female parts of the connector, a tool must be used in order to depress a release pin. This provides the advantage that accidental release of the coupling is not easily achieved.

For some applications, the need for an additional release tool is appropriate, and may be required for insurance or other purposes. For other applications, the need for a release tool may not be appropriate or required, but the other safety advantages of the connector are still worth while. When a release tool is provided, it will often be mislaid, and users will still attempt to separate the connection, using other implements or using their fingernails.

There is therefore a need for an improved release mechanism in this type of electrical connector.

SUMMARY OF THE INVENTION

According to the invention, there is provided an electrical connector comprising:

a male part and a female part;

a bayonet coupling between the male part and the female part;

a spring-loaded pin projecting from one of the male part and the female part, and a recess in the other of the male part and the female part for receiving the pin, wherein the pin is received in the recess when the bayonet coupling is fully engaged, thereby to limit relative rotation between the male part and the female part and to prevent disconnection of the bayonet coupling while the pin is engaged in the recess, wherein the connector further comprises a sleeve surrounding a portion of the part having the recess, the sleeve having a tab which projects into the recess, the sleeve being slidable to make the tab depress the pin against the spring bias of the pin, thereby to enable subsequent disconnection of the bayonet coupling.

This design maintains a locking mechanism to prevent accidental decoupling of the bayonet connection, but makes the decoupling process simpler, by using a sliding and twisting operation rather than needing a specific additional tool.

The male part preferably has a connection portion comprising an outer insulating sleeve and an inner conducting sleeve, and wherein a spring-loaded insulating cover is mounted within the inner sleeve, which is biased by the spring to substantially block the open end of the outer sleeve.

The contacts are thus inside the sleeve behind the cover, so that no live contacts are exposed when the connector is separated. The inner sleeve defines the electrical connector contact of the male part.

The outer insulating sleeve is preferably provided with at least one channel for defining the bayonet coupling.

The female part preferably comprises a second outer insulating sleeve and a connector pin housed within the insulator sleeve. This receives the connection portion of the male part, and the connector pin acts to depress the insulating cover. An end of the connector pin, proximate to the open end of the second outer insulating sleeve, is formed from an insulator, so that again no live contacts are exposed by the disconnected female part.

The connector pin may also comprise a contact which is radially outwardly spring biased. This presses against the inner sleeve of the male part to define a high current electrical connection. The inner surface of the second outer insulating sleeve preferably comprises at least one projection for defining the bayonet coupling, inn conjunction with the channel of the male part.

The sleeve may be releasably connected to the part having the recess, so that the connector can be configured either as a component needing a release tool or as one in which release is simplified.

A coupling may be provided between the sleeve and the part having the recess, the coupling comprising a lug in one of the sleeve and the part and a closed channel for receiving the lug in the other of the sleeve and the part. In this way, the sleeve remains attached when the connector parts are separated.

The novel features of the invention are set forth with particularity in the appended claims. The invention will be best understood from the following description when read in conjunction with the accompanying drawings.

DESCRIPTION OF THE PREFERRED EMBODIMENT

Before describing the improved connector of the invention, the operation of the connector of U.S. Pat. No. 6,309,231 will first be described.

Figure 1:
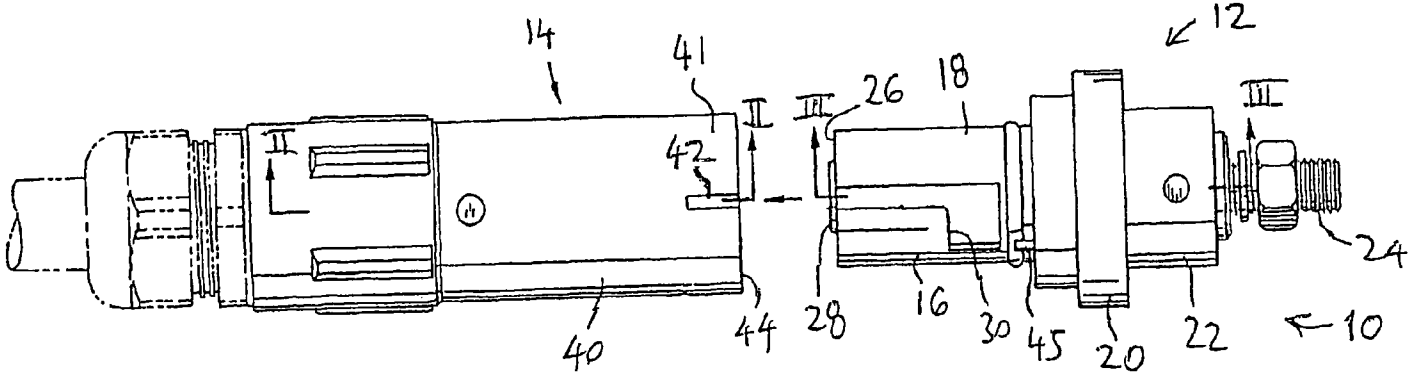
FIG. 1 PRIOR ART
FIG. 1 shows a known connector in a separated state.

FIG. 1 shows the power connector assembly of U.S. Pat. No. 6,309,231, generally indicated at 10 in an uncoupled position.

The assembly 10 has a male connector 12 and a female connector 14. The male connector 12 has a body 16 formed from an electrically insulating material, such as plastic. The male connector 12 has a cylindrical male portion 18, a flange 20 and a rear part 22. The male connector is for connection to a source of high voltage using a conventional threaded connector 24.

The male connector has an end face 26, and an insulating engagement pin 28 projects slightly beyond the end face 26 and engages end piece 56 on the female connector when the connector mate. The male portion 18 has two slots 30, which are used to define a bayonet type coupling with the female connector 14.

The female connector 14 has a cylindrical electrically non-conductive body 40 with a portion 41 having a slot, or recess 42 extending inwardly from an end face 44 of the housing 40. The female connector 14 is also connected to a source of electrical power.

A locking pin 45 projects from a face at the end of the male portion 18, and as will be described below, this provides a safety locking mechanism.

Figure 2:
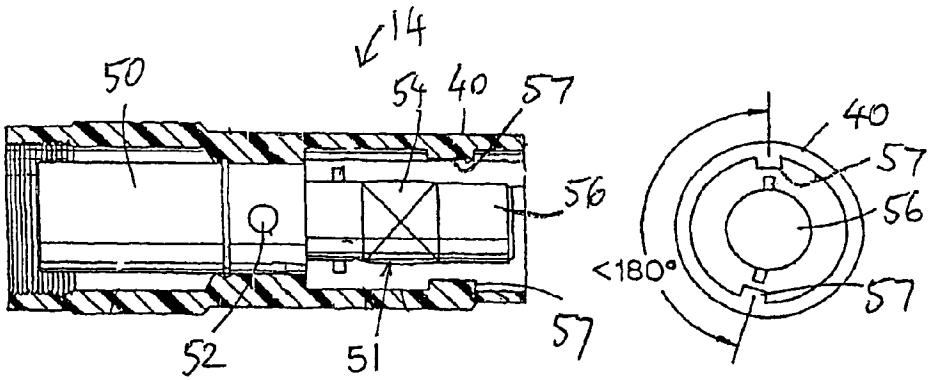
FIG. 2 PRIOR ART
FIG. 2 shows the female part of the connector of FIG. 1 in cross section.

FIG. 2 shows the female connector 14 in cross section. The female connector houses a contact assembly 50 which is pinned to the body 40 using a pin 52 to prevent relative movement. A forward part of the contact assembly 50 includes connector pin 51 with a louver band 54. The louver band 54 is a single, double or multi-louver spring band depending on the voltage applied. Beyond the louver band 54 is an insulating end piece 56, so that all exposed parts of the female connector 14 are insulating.

The inner surface of the housing 40 has two tabs 57, which engage with the slot 30 to form the bayonet coupling. As shown in the end view of FIG. 2, the tabs 57 are not diametrically opposite, so that there is only one relative angular orientation in which the male and female connectors can be joined.

Figure 3:
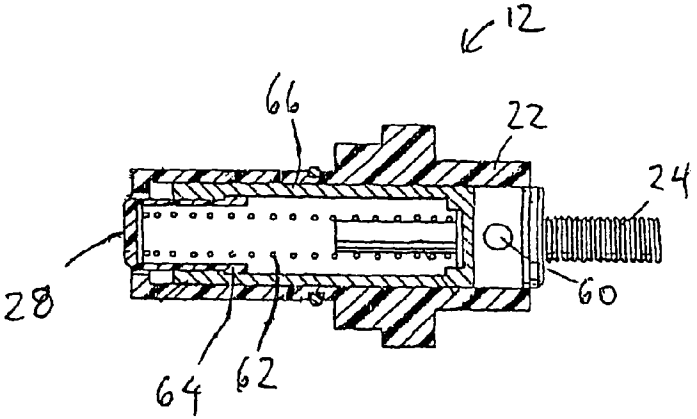
FIG. 3 PRIOR ART
FIG. 3 shows the male part of the connector of FIG. 1 in cross section.

FIG. 3 shows the male connector 12 in cross section. The threaded connector 24 is also pinned to the housing 22 using a pin 60 to prevent relative movement. The engaging pin 28 is biased by a compression spring 62 into the projecting position shown, so that all exposed parts of the male connector are insulating. The engaging pin 28 has a rear shoulder 64 to limit outward movement of the pin 28.

The spring biased engaging pin 28 slides back and forth within the male portion 18 to enable the louver 54 to make electrical connection to the conductive inner sleeve 66 of the male portion 12. The electrical connection is thus made between the louver 54 and the inner sleeve 66, by means of the louver spring bands.

Figure 4:
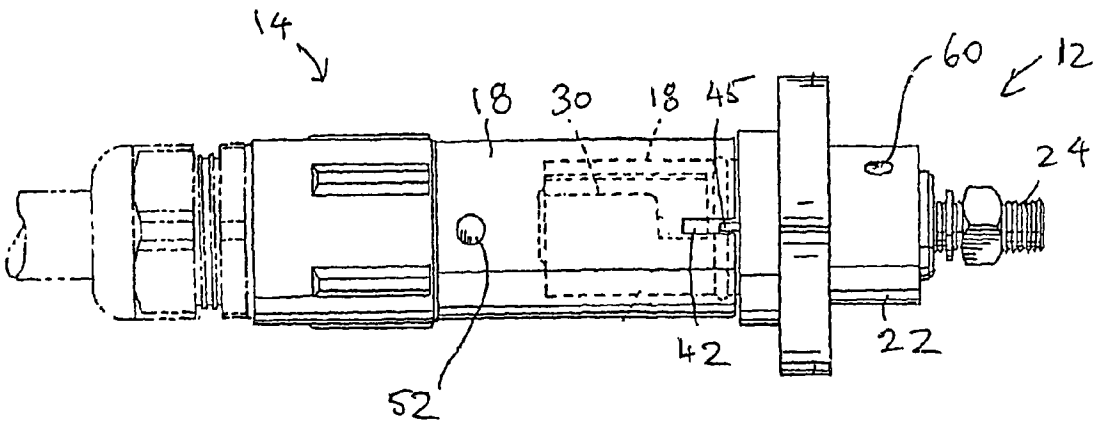
FIG. 4 PRIOR ART
FIG. 4 shows the connector of FIG. 1 in a connected state.
Figure 5:
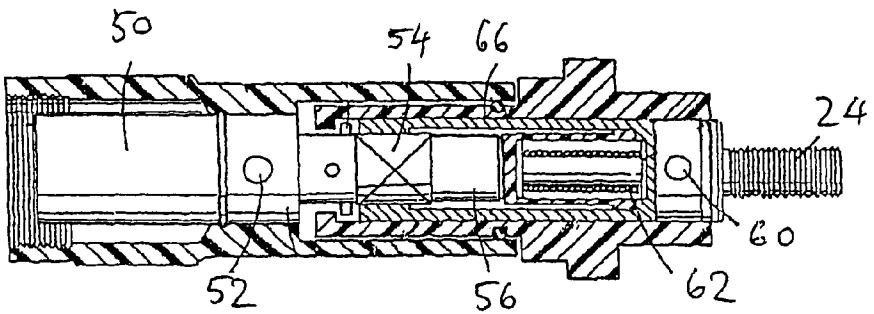
FIG. 5 PRIOR ART
FIG. 5 shows the connector of FIG. 1 in a connected state in cross section.

FIG. 4 shows the connected coupling and FIG. 5 shows the connected coupling in cross section.

To mate the male and female connectors, the tabs 57 are aligned with the slots 30. The end piece 56 engages with the engaging pin 28 which is depressed as the male and female parts are moved together. When fully engaged, the end face 44 of the female connector comes into contact with the locking pin 45. The pin 45 is fully compressed when the male and female connectors are fully pushed together. The male connector 12 is then rotated (clockwise), until the slot 42 reaches the pin which then projects into the slot 42. This prevents any further rotation of the two parts relative to each other. The shape of the slot 30, having a shaft and a head, ensures that in this relative orientation, the male and female connectors cannot be separated, as the tabs 57 are then trapped in the head portions of the recesses 30.

In order to release the connection, the pin must be depressed, and at the same time, the male and female parts are rotated relatively to each other to release the bayonet coupling.

The locking pin is housed in a small enclosure defined by the slot 42, so that this depression is deliberately not a straightforward operation. A tool is provided for insertion into the slot 42, and having a width to fill the slot, and thereby depress the pin, so that the male and female parts can be rotated and released. While this provides an additional level of safety which may be desirable or required, for example if the connectors are in public areas, it can be a nuisance when the level of safety is not required.

The connector above is described in more detail in U.S. Pat. No. 6,309,231, to which reference is made.

The invention provides a modification to the connector described above, which provides similar levels of safety but without requiring additional tools.

In a first embodiment, the invention provides an extra component which can be added to the design described above to avoid the need for a tool. In this way, the—connector can have a single design, and the additional component is then optional, so that use of the connector in some applications will require use of a tool to disconnect the male and female parts, whereas use of the connector in other applications, for example where there is no public access, does not require use of the tool.

Figure 6:
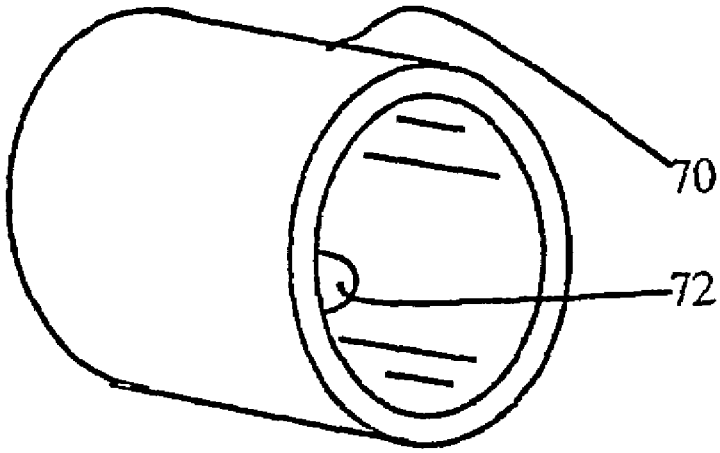
FIG. 6 shows a component of the invention for use with the connector of FIGS. 1 to 5.

FIG. 6 shows the additional component, comprising a sleeve 70 having an inwardly projecting tab 72 designed to fit inside the slot 42.

In use, the sleeve 70 is fitted over a portion 71 of the end 44 of the female connector 14, with the tab 72 sliding into the slot 42. The engagement of the tab 72 with the slot 42 may be the only coupling between the sleeve and the female connector 14, so that a choice of whether or not to use to sleeve 70 can be made when making the electrical connection, and in dependence on the requirements at that location.

Figure 7:
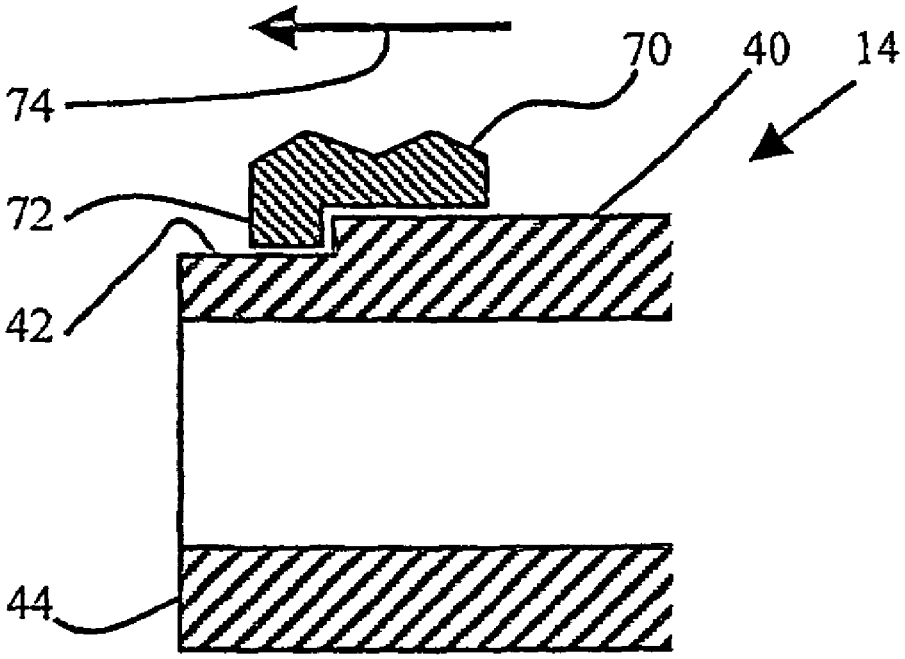
FIG. 7 is a cross section of the component of FIG. 6 in position.

FIG. 7 shows how the tab 72 engages with the slot 42 in the housing 40, so that the slot limits the sliding and rotational movement of the sleeve 70.

In order to release the connector, the sleeve is pushed towards the male connector as shown by arrow 74, and the tab 72 pushes the pin 45 inwardly against the spring bias of the pin. When the pin is fully depressed, the male and female connectors can be rotated to release the bayonet coupling.

In another version, the sleeve is mounted on the housing 40 with a coupling in addition to the engagement of the tab 72 and slot 42. For example, a lug and slot arrangement between the inside of the sleeve 70 and the outside of the housing 40 may hold the housing 40 and sleeve 70 together even when the male and female connectors are separated. Even with this additional coupling between the sleeve and housing, the sleeve may still be removable from the housing by applying sufficient force, but the additional coupling is sufficient that the sleeve does not fall off when the connector is disconnected.

Alternatively, the sliding sleeve can be securely mounted over the housing, so that the connector is supplied only in the format in which it is to be used.

No biasing arrangement for the sleeve is required, as the spring force of the pin 45 is used to push the sleeve away when the male and female connectors are joined.

The connector provided by the invention can be released more easily and without the need for an additional tool. However, the release operation is still a two stage operation, of axial force and simultaneous rotation. The invention also enables a connector to be formed with two possible levels of safety, so that the connector can be used in different ways for different applications.

The sleeve can have a ribbed or other outer surface to improve grip and to make the release operation easier in confined spaces. An end section of the housing 40 can be recessed to house the sleeve, without increasing significantly the total volume of the connector.

Various other modifications will be apparent to those skilled in the art.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector comprising:

a male part and a female part;

a bayonet coupling between the male part and the female part;

a spring-loaded locking pin projecting from one of the male part and the female part, and a slot in the other of the male part and the female part for receiving the locking pin, wherein the locking pin is received in the slot when the bayonet coupling is fully engaged, thereby to limit relative rotation between the male part and the female part and to prevent disconnection of the bayonet coupling while the locking pin is engaged in the slot, wherein the connector further comprises a sleeve surrounding an end of the part having the slot, the sleeve having a tab which projects into the slot, the sleeve being slidable to make the tab depress the locking pin against the spring bias of the locking pin, thereby to enable subsequent disconnection of the bayonet coupling.

2. A connector as claimed in claim 1, wherein the male part has a an outer insulating sleeve and an inner conducting sleeve, and wherein a spring-loaded insulating cover is mounted within the inner sleeve, which is spring biased to substantially block the open end of the outer sleeve.

3. A connector as claimed in claim 2, wherein the inner sleeve defines the electrical connector contact of the male part.

4. A connector as claimed in claim 2, wherein the outer insulating sleeve is provided with at least one channel for defining the bayonet coupling.

5. A connector as claimed in claim 4, wherein the outer insulating sleeve is provided with two channels for defining the bayonet coupling, and which are not symmetrically angularly oriented around the outer sleeve.

6. A connector as claimed in claim 1, wherein the female part comprises a second outer insulating sleeve and a connector pin housed within the outer insulating sleeve.

7. A connector as claimed m claim 6, wherein an end of the connector pin, proximate to the open end of the second outer insulating sleeve, is formed from an insulator.

8. A connector as claimed in claim 6, wherein the connector pin comprises a louver band which is radially outwardly spring biased.

9. A connector as claimed in claim 6, wherein an inner surface of the second outer insulating sleeve comprises at least one tab for defining the bayonet coupling.

10. A connector as claimed in claim 9, wherein the inner surface of the second outer insulating sleeve comprises two projections for defining the bayonet coupling, and which are not symmetrically angularly oriented around the inner surface of the second outer sleeve.

11. A connector as claimed in claim 1, wherein the sleeve is releasably connected to the part having the slot.

12. A connector as claimed in claim 1, wherein a coupling is provided between the sleeve and the part having the slot, the coupling comprising a tab in one of the sleeve and the part and a closed channel for receiving the tab in the other of the sleeve and the part.

13. A connector as claimed in claim 1, wherein the male part has the pin and the female part has the slot.

* * * * *